US010709999B1

(12) United States Patent
Michelsen

(10) Patent No.: US 10,709,999 B1
(45) Date of Patent: Jul. 14, 2020

(54) MAGNETIC BUBBLE WAND

(71) Applicant: Jeff A Michelsen, Glendora, CA (US)

(72) Inventor: Jeff A Michelsen, Glendora, CA (US)

( * ) Notice: Subject to any disclaimer, the term of this patent is extended or adjusted under 35 U.S.C. 154(b) by 0 days.

(21) Appl. No.: 16/510,890

(22) Filed: Jul. 13, 2019

(51) Int. Cl.
*A63H 33/28* (2006.01)
*A63H 5/00* (2006.01)
*A63H 33/26* (2006.01)

(52) U.S. Cl.
CPC ..... *A63H 33/28* (2013.01); *A63H 5/00* (2013.01); *A63H 33/26* (2013.01)

(58) Field of Classification Search
CPC ..... A63H 33/00; A63H 33/28; A63H 33/22; A63H 33/26; A63H 33/046
USPC ..... 446/15–21, 129–139, 92
See application file for complete search history.

(56) References Cited

U.S. PATENT DOCUMENTS 2,994,984 A * 8/1961 Luchsinger ..... A63H 33/26 446/132
3,365,839 A * 1/1968 Luchsinger ..... A63H 33/26 446/137
3,665,637 A 5/1972 Starr
3,818,627 A 6/1974 Lebensfeld
4,295,832 A * 10/1981 Karell ..... A63F 9/0098 273/456
8,717,129 B1 * 5/2014 Cash ..... H01F 7/0236 335/306
2006/0116050 A1 6/2006 Bitton

OTHER PUBLICATIONS

Product Webpage, "Gazillion Incredibubble Multiple Bubble Wand 2 Pack 36379", Gazillion, date visited May 22, 2019, available at https://amzn.to/2HwMroQ.
Product Webpage, "Prodia Rainbow Stick," Colors of Rainbow, date visited May 22, 2019, available at https://amzn.to/2JXYNaY.
Product Webpage, "Super Fun Bubble Wand Assortment (1 Dozen)—Bulk by Fun Express," Fun Express, date visited May 22, 2019, available at https://amzn.to/2HuXwH0.

* cited by examiner

*Primary Examiner* — Kien T Nguyen
(74) *Attorney, Agent, or Firm* — Lincoln Law School of San Jose

(57) ABSTRACT

Apparatuses and methods are provided for making bubbles. In use, an elongated member is provided having a first end and a second end. Additionally, a housing attached to the first end of the elongated member is provided, wherein one or more magnets are disposed in or on the housing.

12 Claims, 5 Drawing Sheets

MAGNETIC BUBBLE WAND

FIELD OF THE INVENTION

The present invention generally relates to bubble wands, and more particularly to magnetic bubble wands.

BACKGROUND

Conventional bubble wands form a film of soap within a shape (e.g., a circular portion of the wand). Waving the wand through the air reforms the soap film into a bubble. Unfortunately, during the time that the soap film sits in the shape, it is subject to molecular decay—which leads to degradation of the properties of the film, which in turn leads to poorer and poorer bubbles the longer the film sits in the shape.

What is needed is a way to extend the time that the soap film retains the desired properties while the soap film is formed in the shape.

SUMMARY

Apparatuses and methods are provided for making bubbles. In use, an elongated member is provided having a first end and a second end. Additionally, a housing attached to the first end of the elongated member is provided, wherein one or more magnets are disposed in or on the housing.

DETAILED DESCRIPTION

Figure 1:
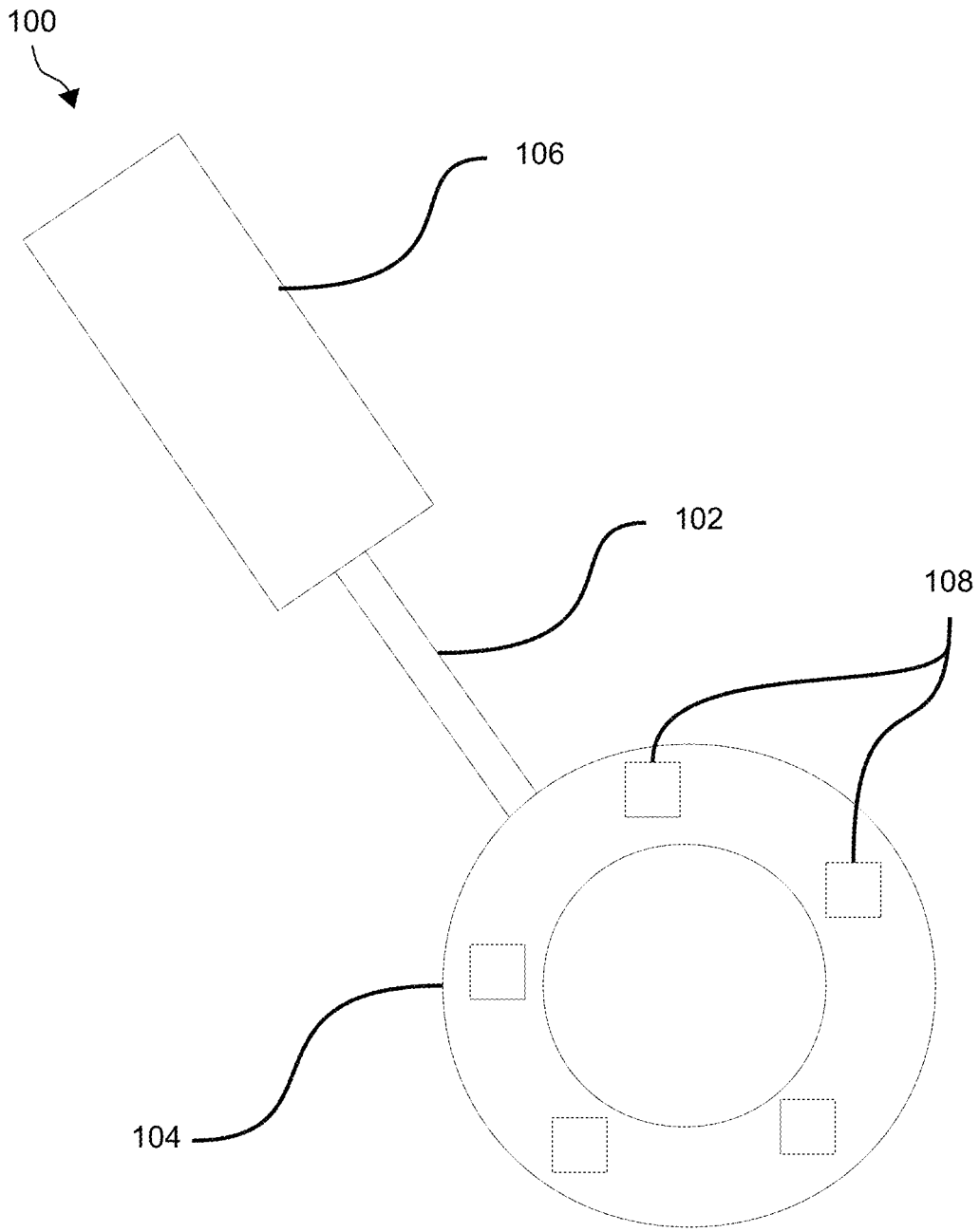
FIG. 1 illustrates the magnetic bubble wand, in accordance with one possible embodiment.

FIG. 1 illustrates an apparatus 100 that serves as a magnetic bubble wand, in accordance with one possible embodiment. As shown, an elongated member 102 is connected to a housing 104 that has one or more magnets 108. Additionally, elongated member 102 is connected to a handle 106. For example, handle 108 is connected to the elongated member that is in turn connected to housing 104. As shown the housing supports disposition of one or more magnets 108.

The housing may be dipped into a soapy solution. Once dipped into the soapy solution, air may be blown through the housing 104 to create a bubble. Additionally, or alternatively, the housing 104 may be spun or waved (or any other type of movement) to create bubbles. In some embodiments, soapy liquid may be placed into the handle 108 to facilitate flow of the soapy liquid through the handle 106, through the elongated member 102, and into the housing 104, thus allowing a film of soapy water to form in the housing.

In one embodiment, the magnetic bubble wand may include an apparatus 100, comprising: an elongated member 102 having a first end and a second end. Housing 104 may be attached to the first end of the elongated member 102. For example, in various embodiments, the elongated member 102 may include, but is not limited to, plastic and/or any other material that is flexible (e.g., pliable under user-generated forces). Alternatively, the elongated member 102 may be constructed of a rigid material that also may be plastic and/or any other material that is rigid or semi-rigid.

Additionally, the housing 104 may be made of either flexible or rigid material or both. The housing 104 may be made of any type of material that allows the housing 104 to hold its shape after repeated uses. The housing 104 may be attached to the elongated member 102 at one point or multiple points of the elongated member 102. The housing 104 may be permanently fixed to the elongated member 102 or detachable from it. The housing 104 may be shaped into any shape that is formed by a member that does not have a defined beginning point and a defined end point. For example, a housing in the shape of a circle does not have a defined beginning point or a defined end point. Additionally, a housing in the shape of a closed rectangle may not include a defined beginning point and a defined end point. The housing 104 may have one or many closed shapes. The shapes may be formed into circles, squares, triangles, or any type of shape that encircles itself. There may be a single shape or many shapes that are attached to the elongated member. The shapes may or may not touch one another.

Still yet, in one embodiment, the handle 106 may be a solid member or may be hollow. The handle 106 may have a battery or batteries inserted through an opening in one of the ends of the handle. Additionally, or alternatively, the handle 106 may have a battery or batteries inserted through an alternative opening in the handle (e.g., via an opening in the side of the handle). The handle 106 may be made of any type of material or combination of materials that allows it to hold a shape. Additionally, there may be a noise-generating device that is inserted into the handle 106. The noise-generating device may be enabled by movement and/or the noise-generating device may be enabled by the battery or batteries inside the handle 106. Still further, there may be a light-generating device that is inserted in the handle 106. Alternatively, the handle 106 may be constructed of solid and/or transparent material allowing light of the light-generating device to emit from the handle 106. The transparent material may be made of multiple colors, or multiple colored lights may be disposed in or on or in juxtaposition to the handle 106. Additionally, the batteries may cause the handle 106 to vibrate and/or cause the noise-generating device to make a sound and/or to cause the light-generating device to emit light. The lights, vibrations, and noise may be operated with a switch or button or some other triggering device either located on one the sides or the end or both of the handle 106. In some embodiments, the sounds, lights, and movements may be enabled through shaking of the handle 106. The elongated member 102 may be inserted in one end of the handle 106. The elongated member 102 may be removable from the housing 104 or permanently attached to the housing.

In one embodiment, the magnets 108 may include any magnetic material capable of producing a magnetic field. There may be one or many magnets 108 in or on or juxtaposed in proximity to the housing. The magnets 108 may be permanently fixed to the housing 104 or may be removable. The magnets 108 may vary in size or type. In one embodiment, a bubble solution may be exposed to a magnetic field (created by the magnets 108). In one embodiment, the magnetic field may change a molecular structure of the bubble created within the housing 104. Further, the bubble solution exposed to the magnetic field may create longer lasting bubbles (compared to a bubble solution that is not exposed to a magnetic field).

Further, the magnetic field may be created in response to a specific north pole/south pole orientation of the magnets 108. In the context of the present description, magnets 108 may include any electromagnetic element and/or material that has magnetic properties.

The following description of the embodiment(s) is merely exemplary (illustrative) in nature and is in no way intended to limit the invention, its application, or uses. Additionally, the invention may be practiced according to the claims without some or all of the illustrative information.

Figure 2:
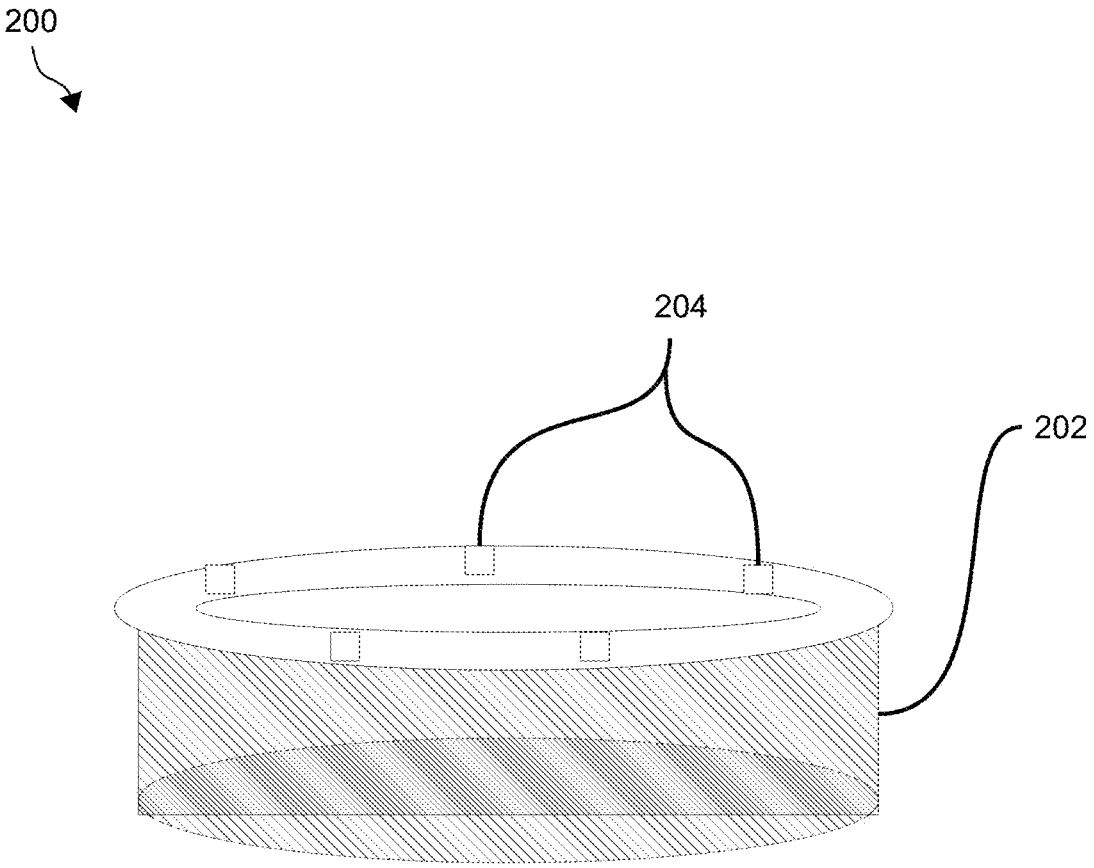
FIG. 2 illustrates magnetic receptacle for use with bubble wand, in accordance with one possible embodiment.

FIG. 2 illustrates a magnetic receptacle for use with a bubble wand in one possible embodiment. As shown, the receptacle 202 has one or more magnets 204 around the perimeter of the receptacle.

In one embodiment, the magnets 204 may include any magnetic material capable of producing a magnetic field. The magnets 204 may be permanently fixed to the receptacle 202 or removable. The magnets 204 may vary in size or type.

In the context of the present description, the receptacle 202 may constructed of any material that allows for liquid to be contained within it.

Figure 3:
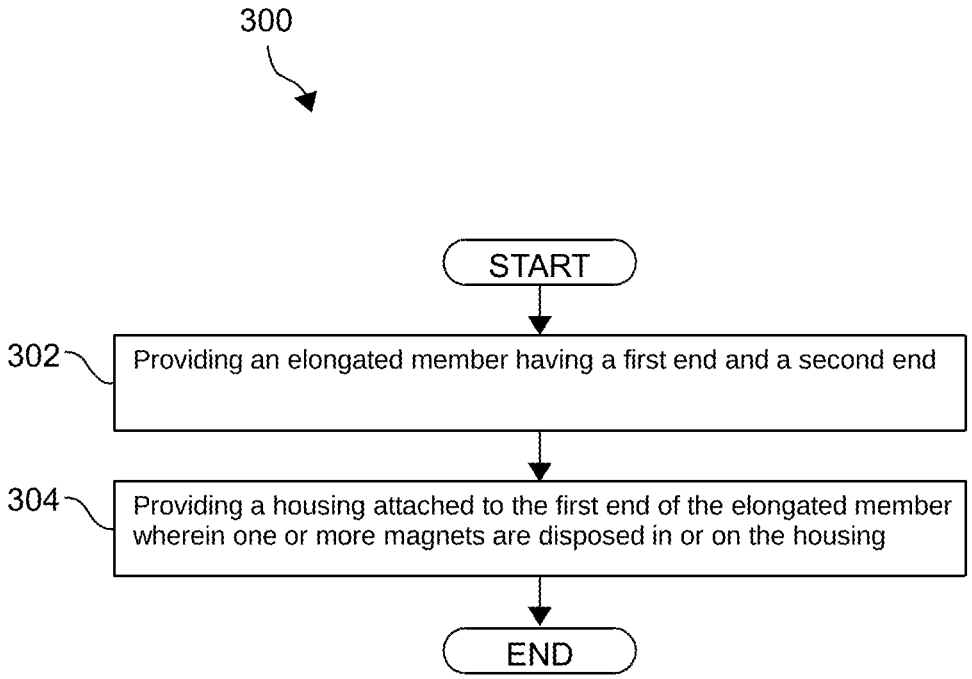
FIG. 3 illustrates a method for making bubbles with a magnetic bubble wand, in accordance with one possible embodiment.
Figure 4:
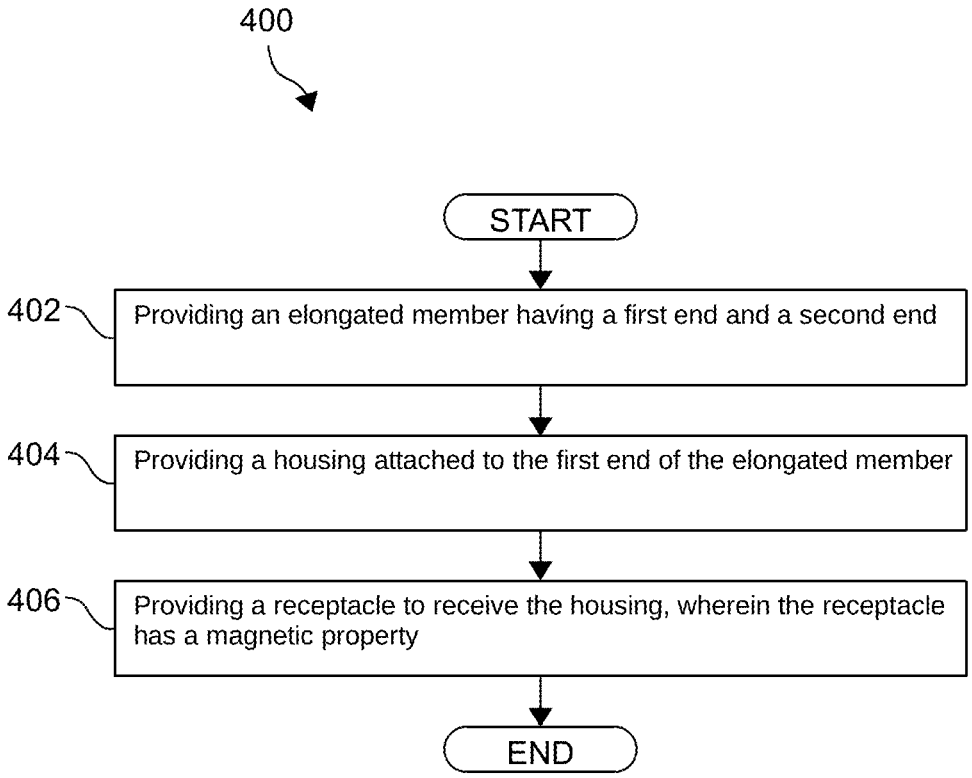
FIG. 4 illustrates a method for making bubbles with a magnetic receptacle, in accordance with one possible embodiment.

FIG. 3 Illustrates a method 300 for manufacturing a bubble wand. The method 300 comprises providing an elongated member that has a first end and a second end. See operation 302. Additionally, the method 300 includes providing a housing attached to the first end of the elongated member wherein one or more magnets are disposed in or on the housing. See operation 304. In one embodiment, the method 300 may include providing a handle that is attached to the elongated member, FIG. 4 Illustrates a method 400 for manufacturing a bubble wand and a magnetic receptacle. The method 400 includes providing an elongated member having a first end and a second end. See operation 402. A housing attached to the first end of the elongated member may be provided. See operation 404. Further, the method 400 includes providing a receptacle to receive the housing, wherein the receptacle has a magnetic property. See operation 406. In one embodiment, a handle may be provided that is attached to the elongated member.

Figure 5:
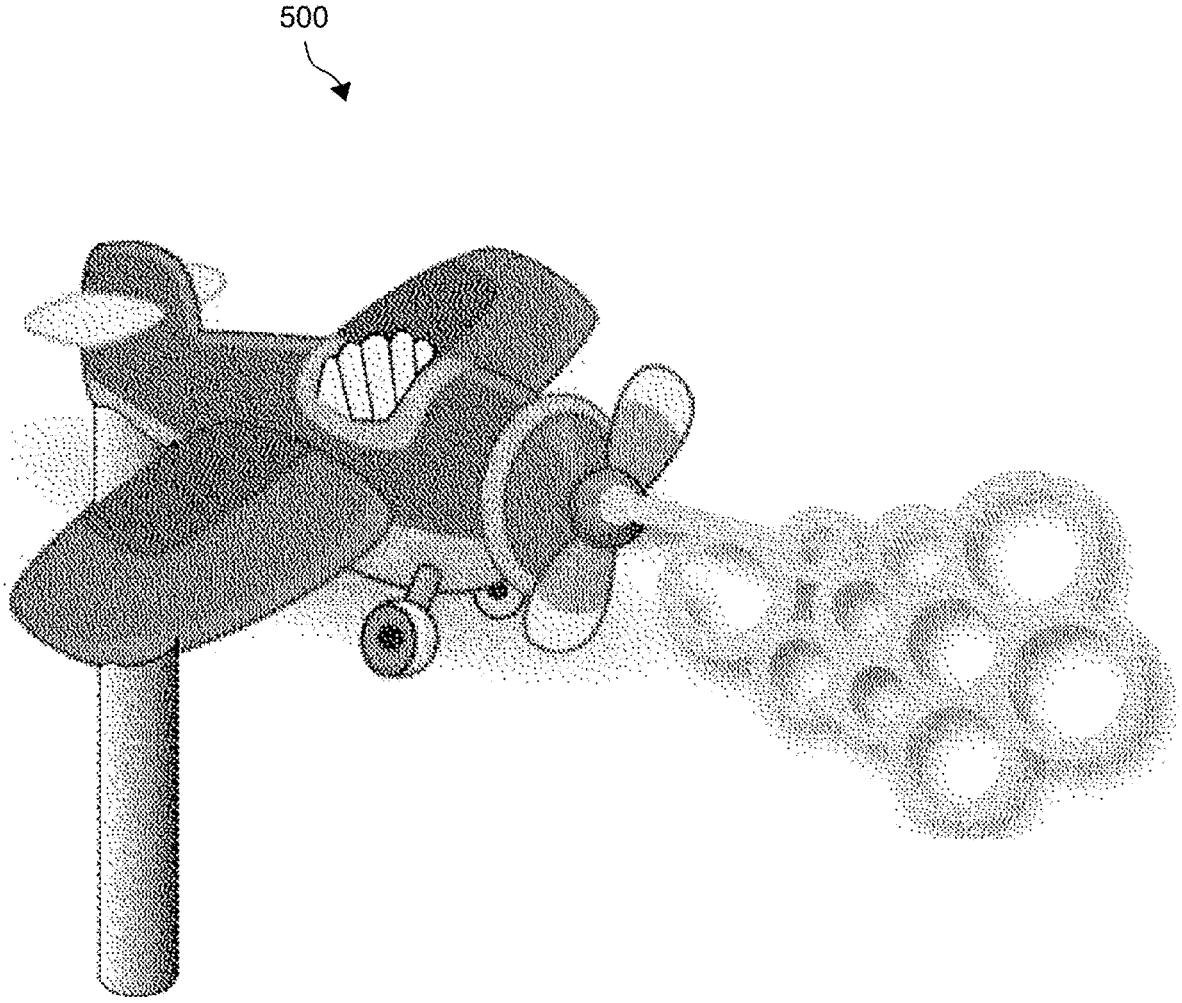
FIG. 5 illustrates an exemplary illustration of a magnetic bubble wand, in accordance with one possible embodiment.

FIG. 5 Illustrates an exemplary illustration 500 of a magnetic bubble wand, in accordance with one possible embodiment. The illustration 500 shows a handle attached to an elongated member (shown as an airplane) which may further be attached to a flexible material which in turn may be connected to a bubble housing portion. The bubble housing portion may include multiple designs (shown in illustration 500 with multiple circles). The bubble housing may also comprise magnets to cause an electromagnetic effect on the bubble solution.

In various embodiments, the bubble wand can be designed of a flexible or ridged materiel. In one embodiment, the wand may be spun or waved in the air, and as the wand pivots and bends (depending on the speed rotation), the pivot angle may create a corresponding aerodynamic affect, which may in turn reduce the airflow on the wand and/or increase the soap solution to retain on the wand longer, thereby increasing the amount of bubbles produced. The flexible housing of the wand may also assist when dipping the wand into the soap tray in that the wand may be evenly coated with the bubble soap solution.

The magnetic effect (of including magnets in the housing and/or different locations of the wand) may be caused by a dipole effect (based on a north and south orientation of the magnets). Of course, the orientation of the magnets is not limited to a particular orientation and can be placed in a variety of orientations that may cause an effect on the bubble solution. As molecules pass by the magnetic field, molecules of the bubble solution may be polarized (organized), thereby causing bubbles to last longer.

While specific embodiments of the invention have been described, it is understood that the present invention is not intended to be limited only to such embodiments. Additionally, the scope of the preferred embodiment should be defined by the following claims and their equivalents. Moreover, any combination of the above-described elements in all possible variations thereof is encompassed unless otherwise indicated herein or otherwise clearly contradicted by context. Further, the use of the terms "a" and "an" and "the" and similar referents in the context of describing the subject matter (particularly in the context of the claims) are to be construed to cover both the singular and the plural, unless otherwise indicated herein or clearly contradicted by context. No language in the specification should be construed as indicating any non-claimed element as essential to the practice of the invention as claimed.

What is claimed is:

1. A bubble wand apparatus, comprising:

an elongated member having a first end and a second end;

a housing attached to the first end of the elongated member, wherein one or more magnets are disposed in or on the housing; and a handle attached to the elongated member, wherein the handle contains at least one magnet.

2. The bubble wand apparatus of claim 1, wherein the elongated member is removably connected to the handle.

3. The bubble wand apparatus of claim 1, wherein the handle is filled with liquid.

4. The bubble wand apparatus of claim 1, wherein the handle comprises a battery.

5. The bubble wand apparatus of claim 4, wherein the battery is housed in a concave portion of the handle.

6. The bubble wand apparatus of claim 4, where in the battery may be operated by a switch on the handle.

7. The bubble wand apparatus of claim 4, where a sound is emitted by operation of the battery.

8. The bubble wand apparatus of claim 1, where in at least one of the one or more magnets is removable.

9. The bubble wand apparatus of claim 1, wherein the housing is formed into a first shape.

10. The bubble wand apparatus of claim 1, wherein the housing is formed of at least one of a rigid material or a flexible material.

11. The bubble wand apparatus of claim 1, wherein the housing is formed into a first shape, and wherein the first shape bounds a plurality of other shapes.

12. The bubble wand apparatus of claim 1, wherein at least one member of the apparatus is dyed.

* * * * *